US005457847A

United States Patent [19]

Uzawa et al.

[11] Patent Number: 5,457,847

[45] Date of Patent: Oct. 17, 1995

[54] DUST REMOVING SYSTEM

[75] Inventors: Hiroshi Uzawa; Shunji Hayashi, both of Osaka, Japan

[73] Assignee: Shinko Co. Ltd., Osaka, Japan

[21] Appl. No.: 169,206

[22] Filed: Dec. 20, 1993

[30] Foreign Application Priority Data

Aug. 31, 1993 [JP] Japan ..... 5-240672

[51] Int. Cl.[6] ..... A47L 5/14

[52] U.S. Cl. ..... 15/345; 15/306.1; 15/309.1

[58] Field of Search ..... 15/306.1, 308, 15/309.1, 309.2, 404, 345

[56] References Cited

U.S. PATENT DOCUMENTS 3,678,534 7/1972 Hilbig ..... 15/345
4,364,147 12/1982 Biedermann et al. ..... 15/404
4,594,748 6/1986 Warfvinge ..... 15/308
4,677,704 7/1987 Huggins ..... 15/306.1 X
4,715,078 12/1987 Howard et al. ..... 15/308 X

FOREIGN PATENT DOCUMENTS

0565811A1 10/1993 European Pat. Off. .

*Primary Examiner*—Chris K. Moore
*Attorney, Agent, or Firm*—Armstrong, Westerman, Hattori, McLeland and Naughton

[57] ABSTRACT

A casing having an air discharging chamber and an air sucking chamber is provided with a first jetting nozzle and a second jetting nozzle on the underside thereof. The first jetting nozzle and the second jetting nozzle jet supersonic airs such as to approach each other. A sucking nozzle is located between the first jetting nozzle and the second jetting nozzle to allow the working air to be sucked in the casing.

12 Claims, 5 Drawing Sheets

DUST REMOVING SYSTEM

BACKGROUND AND SUMMARY OF THE INVENTION

The present invention relates to a dust removing system.

In one of conventional dust removing systems, a dust removing head 113 is located above work 102 which has dust removed from the surface thereof, so as to intersect the traveling direction of the work 102 at right angles. This dust removing head 113 is provided with a casing 103 which is separated into a downstream side air discharging chamber 105 and an upstream side air sucking chamber 106 by using a partition wall 104, and also with a supersonic generator 107 located within the air discharging chamber 105.

Moreover, the air discharging chamber 105 is mounted with a jetting nozzle 108 such that it is opened inside the air discharging chamber, and this jetting nozzle 108 is communicatively connected to the supersonic generator 107. The air sucking chamber 106 is provided with a sucking nozzle 109 such that it is opened inside the air sucking chamber.

In order to remove dust 110 from the work 102, the jetting nozzle 108 jets supersonic operating air obliquely downwardly therefrom onto the surface of the work 102 while the work 102 is moved in the direction shown by means of an arrow 101. The supersonic operating air is air which has ultrasonic waves incorporated therein. The ultrasonic waves incorporated in the air jetted from the jetting nozzle 108 and what is called the air-knife operation of the air flow created by the supersonic air jointly cooperate to produce a synergistic effect in which the dust 110 is exfoliated from the work 102. The dust as exfoliated from the work, and the supersonic air are sucked into the air sucking chamber 106 by means of the sucking nozzle 109.

However, in the foregoing conventional dust removing system, the supersonic operating air emitted from the jetting nozzle 108 passes in a single direction towards the upstream side of the work 102, and for this reason, an air boundary layer 112 is occasionally introduced on the surface of the work 102. The introduction of the air boundary layer 112 would confine the dust 110 into it, and could not exfoliate the dust from the work 102. This is a disadvantage of the conventional dust removing system.

It is therefore an object of the present invention to provide for an improved type dust removing system in which the foregoing disadvantage of the conventional dust removing system is overcome, and any dust adhering to the work can be efficiently removed therefrom by breaking the air boundary layer which occurs during movement of the work.

BRIEF DESCRIPTION OF THE DRAWINGS

The present invention will be described with reference to the accompanying drawings, in which.

DETAILED DESCRIPTION OF THE PREFERRED EMBODIMENTS

Preferred embodiments of the present invention will now be described with reference to the accompanying drawings.

Figure 1:
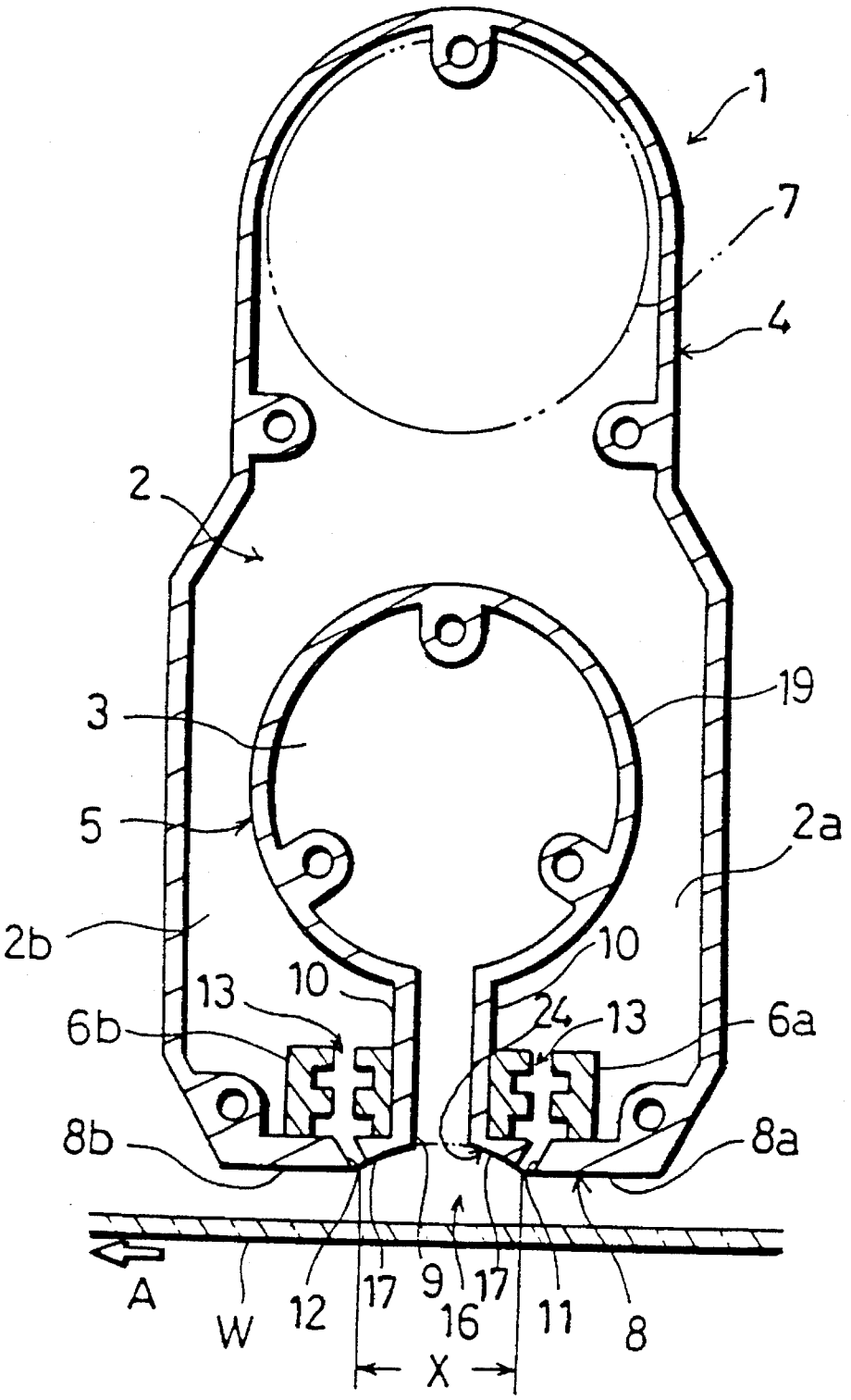
FIG. 1 is a longitudinal sectional side view of a dust removing system according to a first preferred embodiment of the present invention.

FIG. 1 shows in a longitudinal sectional side view the dust removing system according to a first preferred embodiment of the present invention, and the dust removing system shown in this FIG. 1 is provided with a dust removing head 1 and a conveyor means (not shown). FIG. 1 also shows work W which has dust removed from the surface thereof, and this work W and an air blower unit (not shown) are allowed to travel from the upstream side to the downstream side as shown with the arrow A by using the conveyor means (not shown).

The work W comprises a long body of small thickness, such as plastic film, or a sheetlike body such as a glass plate or a panel.

A dust removing head 1 comprises a casing 4 located perpendicularly to the traveling direction of the work W, and supersonic generators *6a*, *6b* installed within the casing 4.

The casing 4 is internally separated by means of a partition wall 5 into an air discharging chamber 2 outside the partition wall 5, and an air sucking chamber 3 inside the partition wall 5 which forms a cylindrical system body 3. The air discharging chamber 2 has an air supplying conduit 7 communicatively connected thereto as shown with an imaginary two-dot chain line in FIG. 1, and the air sucking chamber 3 has an air sucking conduit (not shown) communicatively connected thereto.

The partition wall 5 comprises a pair of parallel normal wall portions 10, 10 in a band-shaped configuration, which connects the cylindrical system body portion 19 and a bottom wall 8 of the casing 4.

The foregoing arrangement is such that the working air is fed to the air discharging chamber 2 from the air blower unit (not shown) through the air supplying conduit 7, and the working air within the air sucking chamber 3 is returned to the air blower unit via the air sucking conduit.

Also, the bottom wall 8 of the casing 4 are provided with a first jetting nozzle 11 near the upstream side and with a second jetting nozzle 12 near the downstream side such that the ends of both nozzles 11 and 12 approach each other, to thereby emit jets of supersonic operating airs from them, while at the same time, a slit-shaped sucking nozzle 9 is disposed between the first jetting nozzle 11 and the second jetting nozzle 12. The supersonic operating airs are those which have ultrasonic waves incorporated in them.

An open end of the sucking nozzle 9 is located in wall surfaces 17, 17 of the bottom wall 8, and these wall surfaces 17, 17 are formed into a concave surface 24 which is upwardly curved in an arc-shaped configuration as sideways viewed.

Also, the air discharging chamber 2 is separated into an upstream side first discharging chamber 2*a* and a downstream side second discharging chamber 2*b*. The first discharging chamber 2*a* has one supersonic generator 6*a* fixed at a bottom portion thereof, and the second discharging chamber 2*b* has the other supersonic generator 6*b* fixed at a bottom portion thereof.

The upstream side first discharging chamber 2*a* is formed with the first jetting nozzle 11 on a bottom wall portion 8*a* thereof, and the downstream side second discharging chamber 2*b* is provided with the second jetting nozzle on a bottom wall portion 8*b* thereof. That is to say, the first jetting nozzle 11 is located at an upstream side marginal end of the concave surface 24, and the second jetting nozzle 12 is disposed at a downstream side marginal end of the concave surface 24. Therefore, the first jetting nozzle 11, the second jetting nozzle 12, and the sucking nozzle 9 are arranged on the underside of the casing 4.

Figure 2:
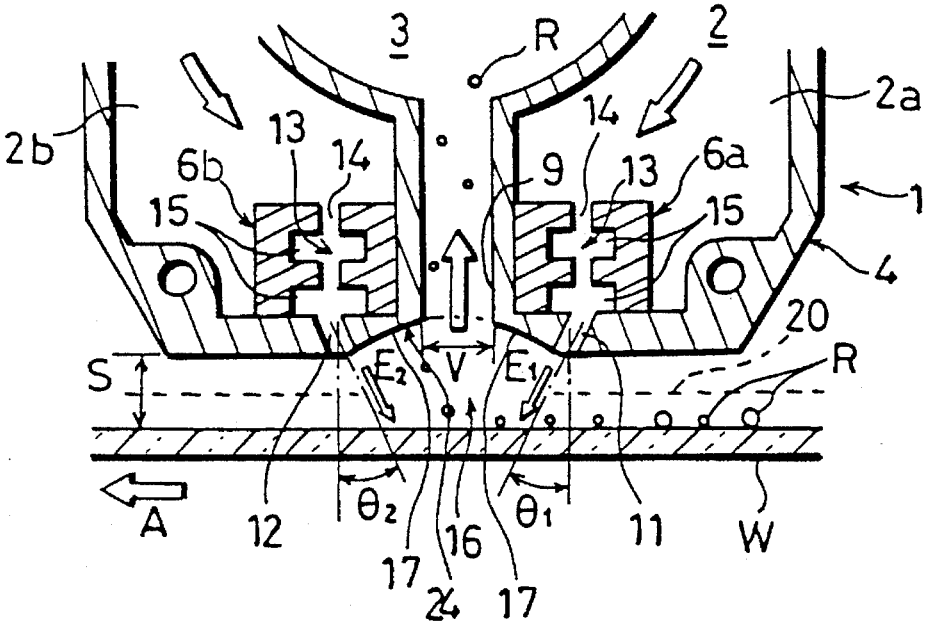
FIG. 2 is an enlarged longitudinal sectional side view of a principal portion of the dust removing system shown in FIG. 1.

As shown in FIG. 2, one supersonic generator 6*a* comprises a blocklike body provided with continuous grooves 13 in parallel with the first jetting nozzle 11, and the other jetting nozzle 6*b* comprises a blocklike body formed with continuous grooves 13 in parallel with the second jetting nozzle 12. Also, the continuous grooves 13 respectively include a normal portion 14, and a pair of upper and lower horizontal portions 15, 15 which are communicatively connected to the normal portion 14.

The first jetting nozzle 11 and the second jetting nozzle 12 are respectively connected to the continuous grooves 13, 13 of the supersonic generator 6*a*, 6*b*.

Also, the first jetting nozzle 11 and the second jetting nozzle 12 gradually approach each other towards their open ends. In this case, the slanting angle θ1 of the first jetting nozzle 11 and that θ2 of the second jetting nozzle 12 respectively range between 10 degrees and 30 degrees, and are preferably approximately 20 degrees.

Figure 6:
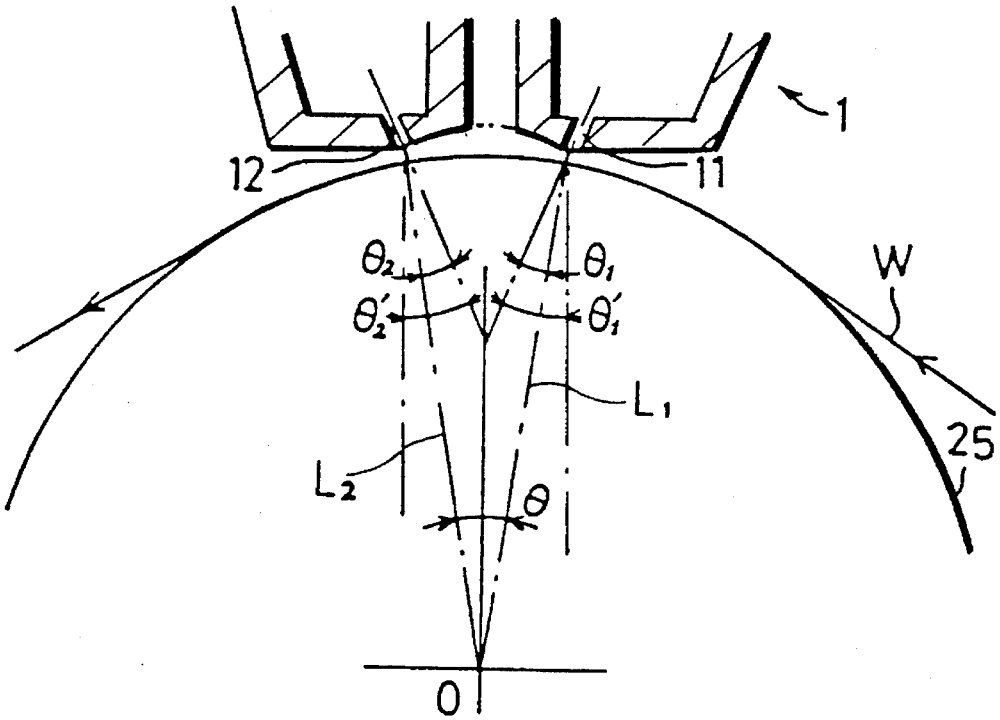
FIG. 6 is an enlarged longitudinal sectional view of a principal portion of the dust removing system shown in FIG. 5, which explains the working state thereof.

As shown in FIG. 6, if the work W is a sheetlike body which is fed while being turned along the roller 25, the slanting angle θ1 of the first jetting nozzle 11 and that θ2 of the second jetting nozzle 12 are respectively θ1' and θ2'. That is to say, in FIG. 6, if the straight line L1 connecting the center O of a roller 25 and one of the outside marginal ends of the concave surface 24, and the straight line L2 connecting the center O of the roller 25 and the other of the outside marginal ends of the concave surface 24 form the angle θ, the angles θ1' and θ2' are expressed by the following equations.

$$\theta 1' = (\theta 1 + \theta/2)$$

$$\theta 2' = (\theta 2 + \theta/2)$$

Also, in FIG. 6, the distance S between the underside of the casing 4 and the surface of the work W preferably ranges between approximately 1 mm and approximately 2 mm. Moreover, in FIG. 1, the distance X between the lower opening portion of the first jetting nozzle 11 and that of the second jetting nozzle 12 is desired to be approximately 30 mm to approximately 40 mm.

If the air sucking chamber 3 has an air sucking conduit communicatively connected in the other end thereof, the distance V between the open end portions of the sucking nozzles 9 may be gradually reduced by stages or without any stage from one end of the air sucking chamber 3 to the other end thereof.

A method in which the dust removing system arranged as described in the foregoing is operated to remove dust R from the work W will next be described.

The work W is moved at a speed of approximately 0.01 m/sec to approximately 10 m/sec in the direction shown with the arrow A in FIG. 2. In this case, the air discharging chamber 2 of the dust removing head is fed with an air of approximately 1200 mm Aq to approximately 1800 mmAq in pressure by using the blower unit.

The pressurized air fed into the air discharging chamber 2 flows at a high speed (approximately 140 m/sec to approximately 200 m/sec) into the continuous grooves 13, 13 of the upstream side supersonic generator 6*a* and the downstream side supersonic generator 6*b*, and is thereby transformed into supersonic airs E1 and E2 which incorporate in them ultrasonic waves of approximately 30 kHz to 120 kHz in frequency. These supersonic airs E1 and E2 are respectively jetted from the first jetting nozzle 11 and the second jetting nozzle 12 in parallel with the slanting angles 81 of the first jetting nozzle 11 and that θ2 of the second jetting nozzle 12.

The supersonic airs E1 and E2 flows such as to approach each other, and meet each other in the middle portion of a spatial chamber portion 16. As a result, turbulence of the airs takes place within the spatial chamber portion 16. In this case, the spatial chamber portion 16 is spacing formed by the first jetting nozzle 11, the second jetting nozzle 12 and the surface of the work W, namely, between the concave surface 24 of the casing 4 and the surface of the work W thereunder.

In general, if an air flows in a single direction along the surface of the work W at a high speed, an air boundary layer 20 is created on the surface of the work W, as shown in FIG. 2. For this reason, the microscopic dust R (of, for example, 1 μm to 10 μm in diameter) adhering to the work W is confined in this air boundary layer 20.

Figure 3:
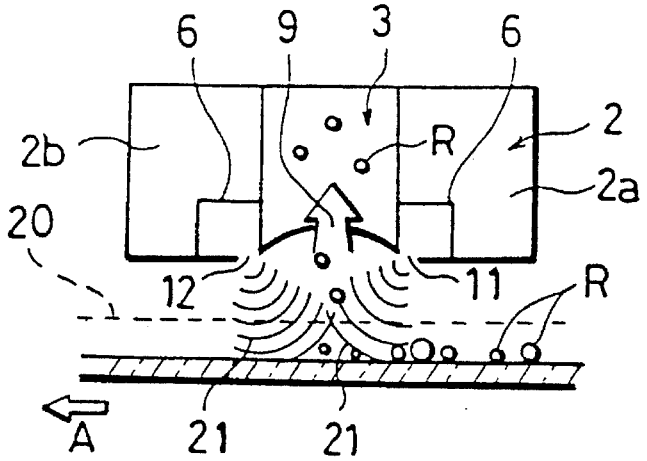
FIG. 3 is a schematic diagram which explains the operating state of the dust removing system shown in FIG. 1.

On the other hand, however, in the dust removing system according to the present invention, air turbulence in the spatial chamber portion 16 makes occurrence of the air boundary layer substantially impossible. Even if the air boundary layer 20 takes place, this air boundary layer 20 is immediately destroyed by means of the ultrasonic waves 21, 21 and the foregoing air turbulence, as shown in FIG. 3. As a result, the operating air comes in direct contact with the surface of the work W, and an effect of what is called the air knife allows the dust R to be exfoliated from the surface of the work W.

Figure 4:
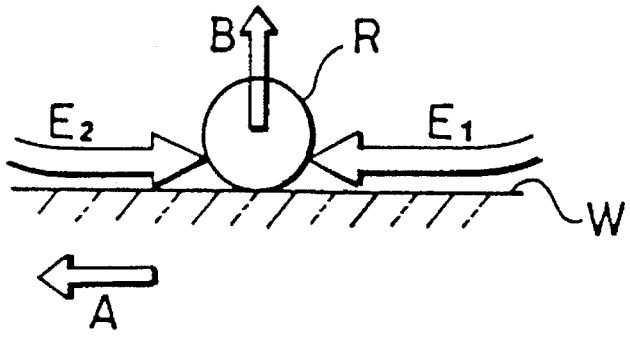
FIG. 4 is a schematic diagram explaining the manner in which supersonic airs incorporating ultrasonic waves in them create buoyancy on work intended to have dust removed from the surface thereof.

Moreover, as enlargedly shown in FIG. 4, at the junction of the supersonic airs E1 and E2, the work W is subjected to the supersonic airs E1 and E2 which are directly opposed, or which respectively come from the upstream side and the downstream side of the work W, to thereby create buoyancy on the dust R in the direction of the arrow B. As a result, the dust R can be positively exfoliated from the surface of the dust R.

The dust R thus exfoliated from the surface of the work W is intended into the suction nozzle 9, and is sucked into the air sucking camber 3. See FIG. 2. Thus, the dust R removing process is completed in the dust removing system according to the present invention.

Figure 7:
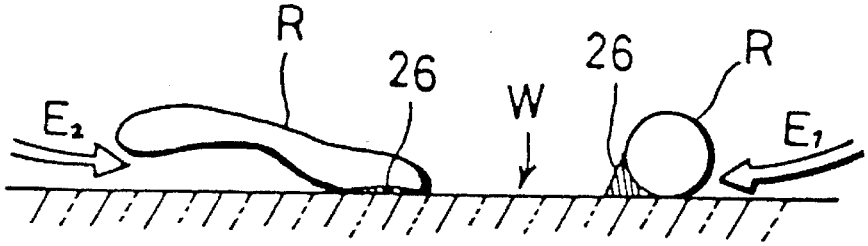
FIG. 7 is a schematic diagram which explains the dust removing operation of the supersonic airs.

The dust R is easily removable or difficult of removal from the work W according to the position thereof at which it adheres to the work W. That is to say, in FIG. 7, the left hand side dust R can easily be swept off by means of the supersonic air E2 jetted from the left hand side, and the right hand side dust R is easily removable by using the supersonic air E1 jetted from the right hand side.

However, in the dust removing system according to the present invention, since the supersonic airs E1 and E2 are jetted in the opposite directions, the dust R can be positively removed regardless of the position thereof at which it adheres to the work W. Therefore, the dust removing system of the present invention can achieve efficient removal of the dust R adhering to the work W, thereby producing superior cleaning effect upon the work W.

Figure 5:
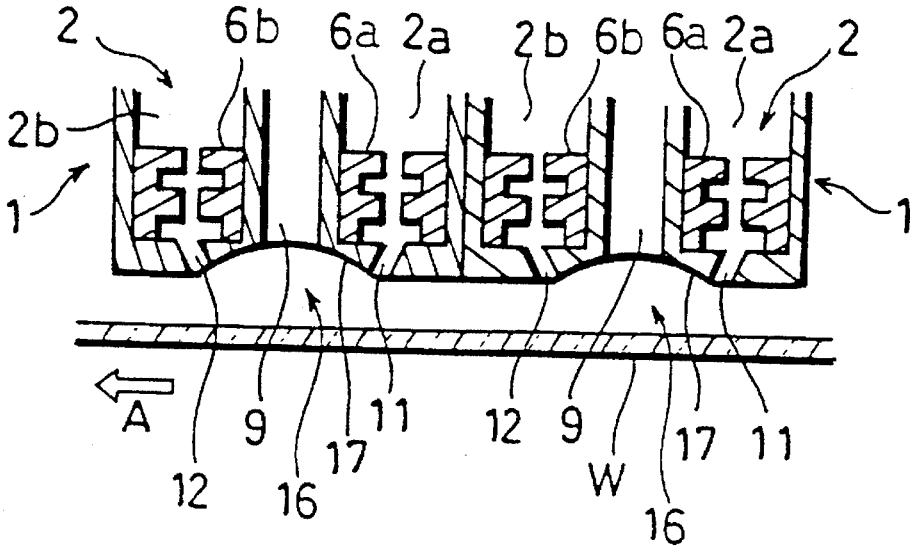
FIG. 5 is a longitudinal sectional side view of a principal portion of the dust removing system according to a second preferred embodiment of the present invention.

FIG. 5 shows a second preferred embodiment of the present invention, in which two dust removing heads 1, 1 are located on the upstream side and the downstream side in parallel with and adjacent to each other. This arrangement of the dust removing heads enhances the efficiency of removing the dust R from the surface of the work W, and ensures the removal of the dust R.

The two dust removing heads 1, 1 may be integrated into a single unit body. In this case, the wall portion between the downstream side air discharging chamber **2*b* of the upstream side dust removing head 1 and the upstream side air discharging chamber 2*a* of the downstream side dust removing head 1 may be omitted so that the downstream side air discharging chamber 2*b* and the upstream side air discharging chamber 2*a*** are communicatively connected to each other.

Figure 9:
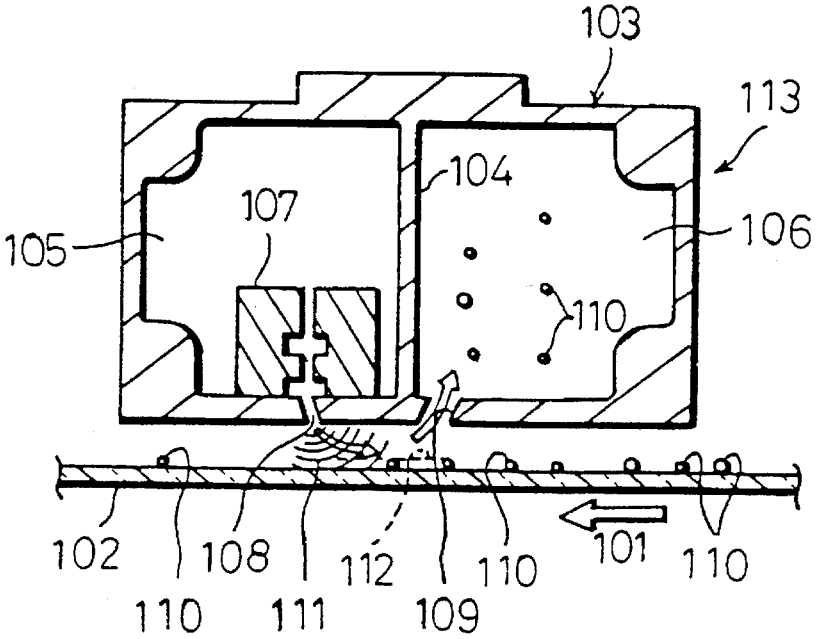
Fig. 9 PRIOR ART
FIG. 9 is a longitudinal sectional view which shows an example of conventional dust removing systems.

Results of experiments will next be described in which a comparison is made between the dust removing system of the present invention and the conventional dust removing system such as illustrated in FIG. 9 in the dust removing effect.

Figure 8:
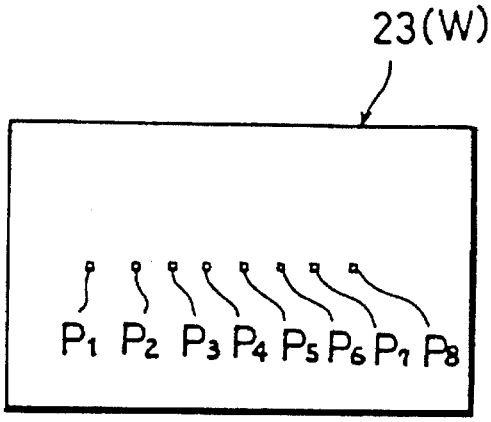
FIG. 8 is a plan view of experimental work, namely, a dust removing object which is intended to have dust removed from the surface thereof.

In the experiments, six flat glass plates 23 in a rectangular configuration were scattered with spacer beads on their surfaces, to thereby use the glass plates as the works W. See FIG. 8. The conventional dust removing system shown in FIG. 9 and the dust removing system according to the present invention which was illustrated in FIG. 1 were operated by using three glass plates for each system. The working air jetted from the jetting nozzles 11 and 12 was pressurized to 1600 mmAq., and the distance between the dust removing head and the surface of the work were adjusted to 4 mm to 5 mm.

Also, the glass plates 23 were respectively marked with points P1 to P8 of 2 sq.mm in area in line and at regular intervals. See FIG. 8. The spacer beads of 5 μm in diameter, such as applied to a liquid crystal display used in, for example, a portable television set, were scattered on the surface of each glass plate at a rate of 300 pcs. to 400 pcs. for each of the points P1 to p8.

After the foregoing comparative experiments were finished, each glass plate was checked to count the number of the spacer beads which remain at each of the points P1 to P8 thereof. The results of counting are as tabled in the following page.

TABLE

| Points | P1 | P2 | P3 | P4 | P5 | P6 | P7 | P8 |
|---|---|---|---|---|---|---|---|---|
| 1st Glass Plate | | | | | | | | |
| The Number of remaining Beads in Conventional System | 2 | 3 | 10 | 15 | 1 | 3 | 4 | 4 |
| The Number of Remaining Beads in System of Present Invention | 0 | 1 | 0 | 0 | 0 | 4 | 3 | 0 |
| 2nd Glass Plate | | | | | | | | |
| The Number of Remaining Beads in Conventional System | 2 | 3 | 2 | 3 | 7 | 9 | 3 | 6 |
| The Number of Remaining Beads in System of Present Invention | 0 | 1 | 0 | 0 | 0 | 4 | 3 | 0 |
| 3rd Glass Plate | | | | | | | | |
| The Number of Remaining Beads in Conventional System | 5 | 5 | 11 | 13 | 4 | 7 | 6 | 5 |
| The Number of Remaining Beads in System of Present Invention | 3 | 1 | 0 | 0 | 2 | 4 | 2 | 3 |

The tabled results show that the dust removing system of the present invention is superior in the dust removing performance thereof to the conventional dust removing system.

As is apparent from the foregoing description, the dust removing system according to the present invention can achieve the efficient removal of the dust R from the work W, and is thus superior in the cleaning effect thereof upon the work W.

Also, the dust removing system of the present invention is arranged to prevent any leakage of the working air on the upstream side of the first jetting nozzle 11 and the downstream side of the second jetting nozzle 12, to thereby allow the infallible introduction of the dust R exfoliated from the work W into the sucking nozzle 9. Moreover, this dust removing system according to the present invention is arranged to prevent a leakage of operating noises outside it.

Also, in the dust removing system of the present invention, the first jetting nozzle 11, the second jetting nozzle 12 and the sucking nozzle 9 are allowed to be arranged on the underside of the casing 4 which is provided with the air discharging chamber 2 and the air sucking chamber 3. Therefore, the dust removing system can be easily assembled, and also the first and second jetting nozzles 11 and 12 and the air sucking nozzle 9 are allowed to be easily positioned.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein.

We claim:

1. A dust removing system for removing dust from a surface, comprising:

a first jetting nozzle which emits a first jet of air which is ultrasonically vibrated, a second jetting nozzle which emits a second jet of air which is ultrasonically vibrated, the first and second jetting nozzles being directed such that the first and second jets of air approach each other, and a vacuum nozzle interposed between said first jetting nozzle and said second jetting nozzle, for vacuuming dust removed from the surface by air supplied by said first and second jetting nozzles.

2. The dust removing system as set forth in claim 1, further comprising a spatial chamber portion disposed between said first and second jetting nozzles and extending in a direction away from the surface from which dust is to be removed.

3. The dust removing system as set forth in claim 2, wherein said surface is a surface of a work which is a long body of small thickness.

4. The dust removing system as set forth in claim 2, wherein said surface is a surface of a work which is a sheetlike body.

5. The dust removing system as set forth in claim 2, wherein said surface is a surface of a work which comprises plastic film.

6. The dust removing system as set forth in claim 2, wherein said surface is a surface of a work which comprises a glass plate.

7. The dust removing system as set forth in claim 1, wherein said vacuum nozzle includes an aperture in a concave wall as viewed in a direction from the surface from which dust is to be removed.

8. The dust removing system as set forth in claim 7, wherein said concave surface is provided with said first jetting nozzle at an upstream side marginal end thereof, and with said second jetting nozzle at downstream side thereof.

9. The dust removing system as set forth in claim 8, wherein a distance between said underside of said casing and the surface of a work from which dust is to be removed ranges between 1 mm and 2 mm.

10. The dust removing system as set forth in claim 1, further comprising a casing which supports said first jetting nozzle, said second jetting nozzle and said vacuum nozzle said first jetting nozzle, said second jetting nozzle, and said vacuum nozzle being disposed on an underside of said casing, said casing further comprising an air discharging chamber.

11. The dust removing system as set forth in claim 1, wherein said first jetting nozzle and said second jetting nozzle are fixed such that said first and second jets of air are inclined at respective slanting angles $\theta 1$ and $\theta 2$ relative to a normal through the surface from which dust is to be removed, and wherein $\theta 1$ ranges from 10 degrees to 30 degrees, and wherein $\theta 2$ ranges from 10 degrees to 30 degrees.

12. The dust removing system as set forth in claim 1, wherein a distance between respective lower opening end portions of said first jetting nozzle and said second jetting nozzle ranges between 30 mm and 40 mm.

* * * * *